US005419599A

United States Patent [19]

Georgopoulos

[11] Patent Number: 5,419,599

[45] Date of Patent: May 30, 1995

[54] ROTATABLE SEAL

[75] Inventor: George Georgopoulos, Pine Brook, N.J.

[73] Assignee: E. J. Brooks Company, Newark, N.J.

[21] Appl. No.: 82,680

[22] Filed: Jul. 1, 1993

[51] Int. Cl.[6] ..... B65D 33/34

[52] U.S. Cl. ..... 292/326; 292/315

[58] Field of Search ..... 292/307 R, 307 B, 326, 292/315, 317, 325

[56] References Cited

U.S. PATENT DOCUMENTS

| | | |
|---|---|---|
| 421,951 | 2/1890 | MacCarthy . |
| 1,826,033 | 7/1930 | Webster . |
| 4,978,026 | 12/1990 | Gnoinski . |
| 5,180,200 | 1/1993 | Georgopoulos et al. . |

FOREIGN PATENT DOCUMENTS

| | | |
|---|---|---|
| 2-8310 | 3/1990 | Japan . |

*Primary Examiner*—Peter M. Cuomo
*Assistant Examiner*—Monica E. Millner
*Attorney, Agent, or Firm*—William Squire

[57] ABSTRACT

A thermoplastic housing has a chamber open at one end and a thermoplastic rotor inserted in the chamber. The housing wall contains bores aligned across the chamber and two annular grooves in the chamber adjacent the chamber entrance. Tabs are formed adjacent the chamber entrance. The rotor has a bore and two annular ridges near its top. The ridges are relieved complementarily to the tabs. The rotor is inserted and locked axially in the housing by snapping the ridges into the grooves. The tabs are located in the relieved areas to align all of the bores so that a seal wire may thereafter be inserted through the bores. The rotor includes flexible spiral-like co-planar pawl teeth which engage ratchet teeth formed on the housing in the chamber. The ratchet and pawl teeth rotationally lock the rotor relative to the housing while permitting the rotor to bend a seal wire inserted in the bores during rotation which rotation in one direction locks the rotor. The ratchet and pawl teeth may also be used align the bores for insertion. The rotor is rotated manually by a hand-operated tool such as a screwdriver. With a seal wire inserted, the rotor and housing are relatively rotated to wrap the wire about the rotor. Each ridge snaps into one groove when the rotor is inserted into a corresponding housing.

17 Claims, 5 Drawing Sheets

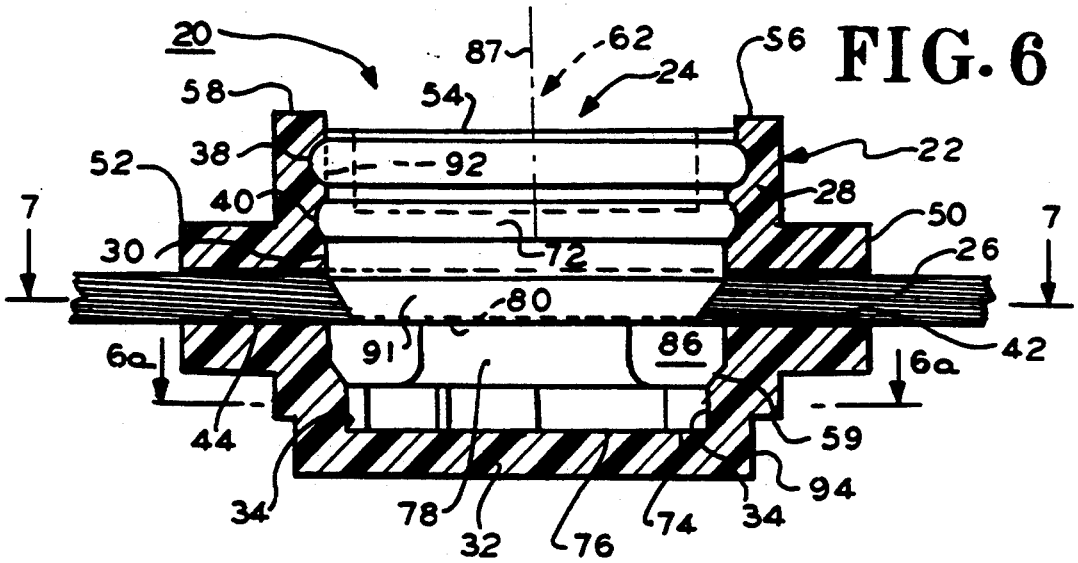
FIG. 6
FIG. 6a
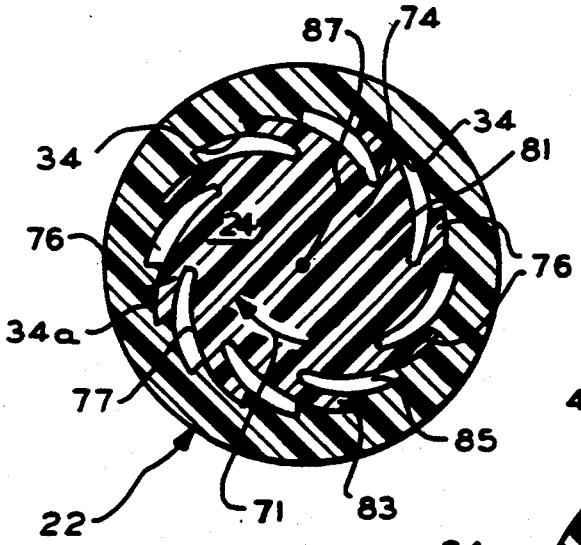
FIG. 7
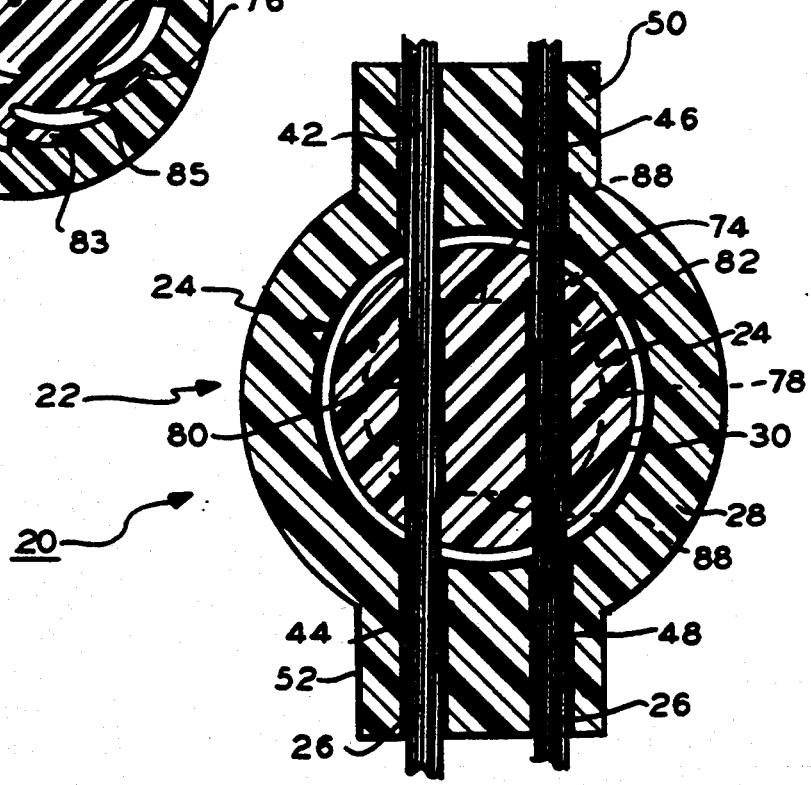

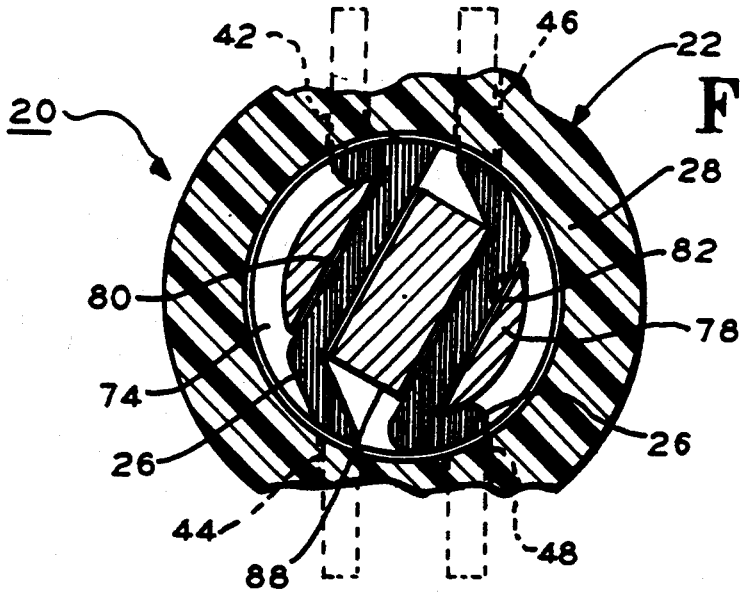
FIG. 10
FIG. 11
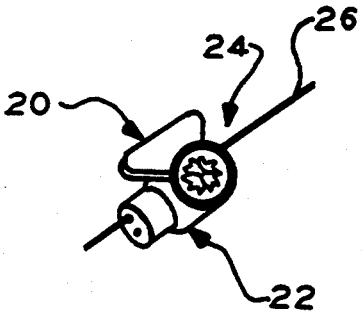
FIG. 13
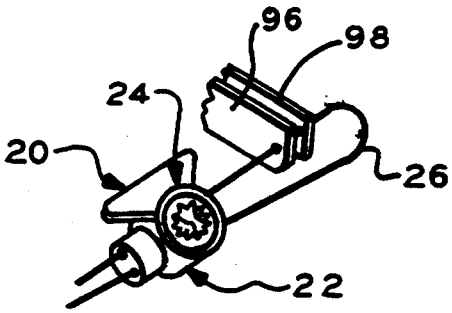
FIG. 12
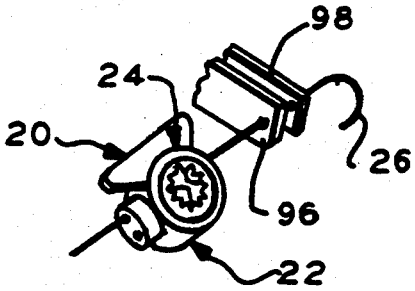
FIG. 14
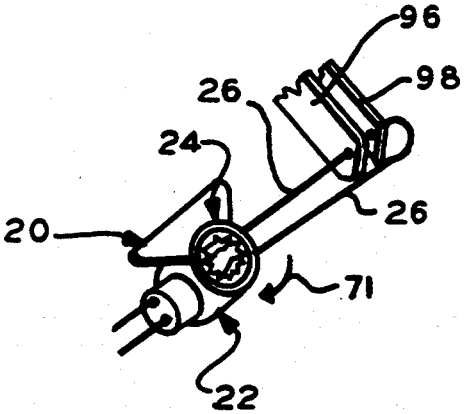

ROTATABLE SEAL

FIELD OF THE INVENTION

This invention relates to a seal for securing containers, and, more particularly to a rotatable seal for preventing removal of sealing wire from a hasp, staple or similar member of a lock or latch which secures a container. The seal is destroyed when removed.

CROSS-REFERENCE TO RELATED APPLICATIONS

Of interest are commonly owned U.S. Pat. Nos. 4,978,026 and 5,180,200 which relate to rotatable seals.

BACKGROUND OF THE INVENTION

Various devices for sealing the hasps or staples of locks or latches which secure containers such as railroad boxcars, trucks semi-trailers, intermodal containers, barrels, electrical equipment containers and the like, have long been used as a means of assuring the security and integrity of the goods or items contained therein. Typical of such devices is a seal which comprises an elongated, flexible sealing wire and a metal seal. The wire is passed through the hasp or staple and then its ends are retained by the metal seal which is crimped or deformed to prevent removal of the wire ends. Since the presence of the wire prevents operation of the harp or staple, unauthorized entry into the container entails rendering the metal seal or the wire disintegral, thus creating visual evidence of the unauthorized entry.

Examples of prior art seals may be found in U.S. Pat. Nos. 421,951, 1,826,033 and 1,911,060.

U.S. Pat. No. 421,951 issued Feb. 25, 1890, discloses a rotatable seal lock wherein a strip seal is inserted within a rotatable member. Thereafter the member is rotated causing a dog to be received within an opening in the strip and pulled within the rotatable member to a retained position. The rotatable member is held against unlocking rotation by the use of a spring-loaded pawl.

U.S. Pat. No. 1,826,033 discloses a block with a sealing chamber with transverse holes. A roller is in the chamber and has a cross-partition for temporary engagement with a winding means inserted through the chamber. The winding means has holes to receive a sealing band.

U.S. Pat. No. 1,911,060, issued May 23, 1933, discloses a sealing device having a body with apertures through which a flexible sealing means can extend. The center portion of the body is provided with a threaded bore which is intersected by the apertures. Disposed within the threaded bore is a uni-rotational screw which may be tightened down against the flexible securing means to retain it in a sealed position.

The aforementioned, commonly owned U.S. Pat. Nos. 4,978,026 and 5,180,200 are directed to providing a simple seal for securing a container and providing clear evidence of tampering as well as being economical to manufacture. In particular, in the seal disclosed in U.S. Pat. No. 5,180,200, a rotatable rotor is insertable in a chamber in a thermoplastic housing. The housing wall contains bores aligned across the chamber. The housing wall further has two annular grooves adjacent the chamber entrance. The rotor has a bore and two annular ridges near its top. The rotor is partially inserted in the housing by snapping the lower ridge into the upper groove of the chamber and locating the tabs on the housing in relieved areas to align all the bores so that a seal wire may be inserted through the seal. The ridge-groove and tab-relief cooperation prevent inadvertent and relative rotation of the rotor and housing and full insertion of the rotor into the chamber. With a seal wire inserted, the rotor and housing are relatively rotated to wrap the wire about the rotor. The rotor is then fully inserted into the housing so that each ridge snaps into one groove. This and engagement of teeth on the bottom of the rotor which mate in teeth at the base of the chamber prevent removal of the rotor from the housing, relative rotor-housing rotation, and removal of the wire from the seal. This seal arrangement has achieved widespread commercial success.

However, in operation of the seal as mentioned above, the rotor is only partially inserted and then receives a sealing wire after which the rotor is rotated and then fully inserted. The rotation of the rotor to wrap the wire thereabout and fully insert the rotor into the chamber requires a specially adapted tool. The present inventor recognizes a need for a seal similar to the one disclosed in the aforementioned U.S. Pat. No. 5,180,200, in which the seal can be utilized without a specially adapted tool and can use conventional screwdrivers and similar manually operated tools.

SUMMARY OF THE INVENTION

A seal according to the present invention operates with a flexible seal wire and two interlocked, relatively rotatable members preferably molded from a frangible plastic. A flexible seal wire is passed through a hasp, staple or other locking arrangement and then its ends are inserted through aligned apertures in both of the interfitted members. Relative rotation is then imparted between the interlocked members to cause the wire to be wrapped around one member and thereby deformed and locked between the members. The members include means for permitting one member to rotate only in one direction relative to the other member while wrapping the wires. The means and the wrapped wire lock the members in the relative angular position to which the members are rotated.

One member is a rotor and the second is a female housing defining a chamber open at one end. The rotor is axially inserted into and axially locked in the chamber and the members thereafter relatively rotated. The members each have bores therethrough generally transverse to the axis of relative rotation. The bores are alignable by relative rotation of the interfitted members. The ends of a flexible sealing wire are passed through the aligned bores, and the members are then relatively rotated to misalign the bores and wrap the wire at least partially around the rotor which wrapping deforms the wire. The members so positioned may have misaligned bores and are rotably and axially locked together. The deformed wire cannot thereafter be withdrawn from the members.

BRIEF DESCRIPTION OF THE DRAWINGS

A more complete understanding of the rotatable seal of the present invention may be had from the following detailed description thereof, particularly when read in the light of the accompanying drawings, wherein:

FIG. 6 is a side elevation view, partially in section, of the housing and rotor of FIGS. 1–5 with the rotor in the locked fully inserted state assembled with an undeformed seal wire;

FIG. 6*a* is a sectional plan view taken along lines 6*a*—6*a* of FIG. 6 illustrating a ratchet and pawl mechanism coupling the rotor to the housing;

FIG. 7 is a cross-sectional plan view of the rotatable seal taken along lines 7—7 of FIG. 6;

FIG. 10 is a cross-sectional plan view of the rotatable seal of the present invention at the beginning of deformation of the seal wire by rotation of the rotor; and FIGS. 11–14 are generalized perspective views illustrating the sequence of assembling the seal of the present invention to secure a hasp or the like.

DETAILED DESCRIPTION OF THE PREFERRED EMBODIMENT

The rotatable seal 20 of the present invention (FIGS. 6—7) is best initially described with reference to FIGS. 1–5. The rotatable seal 20 includes a female housing 22, FIGS. 1 and 2, a male rotor 24, FIGS. 3–5, and a flexible seal wire 26 (FIGS. 6–16). The housing 22 and rotor 24 are both preferably molded from frangible thermoplastic, but may be other materials.

Figure 1:
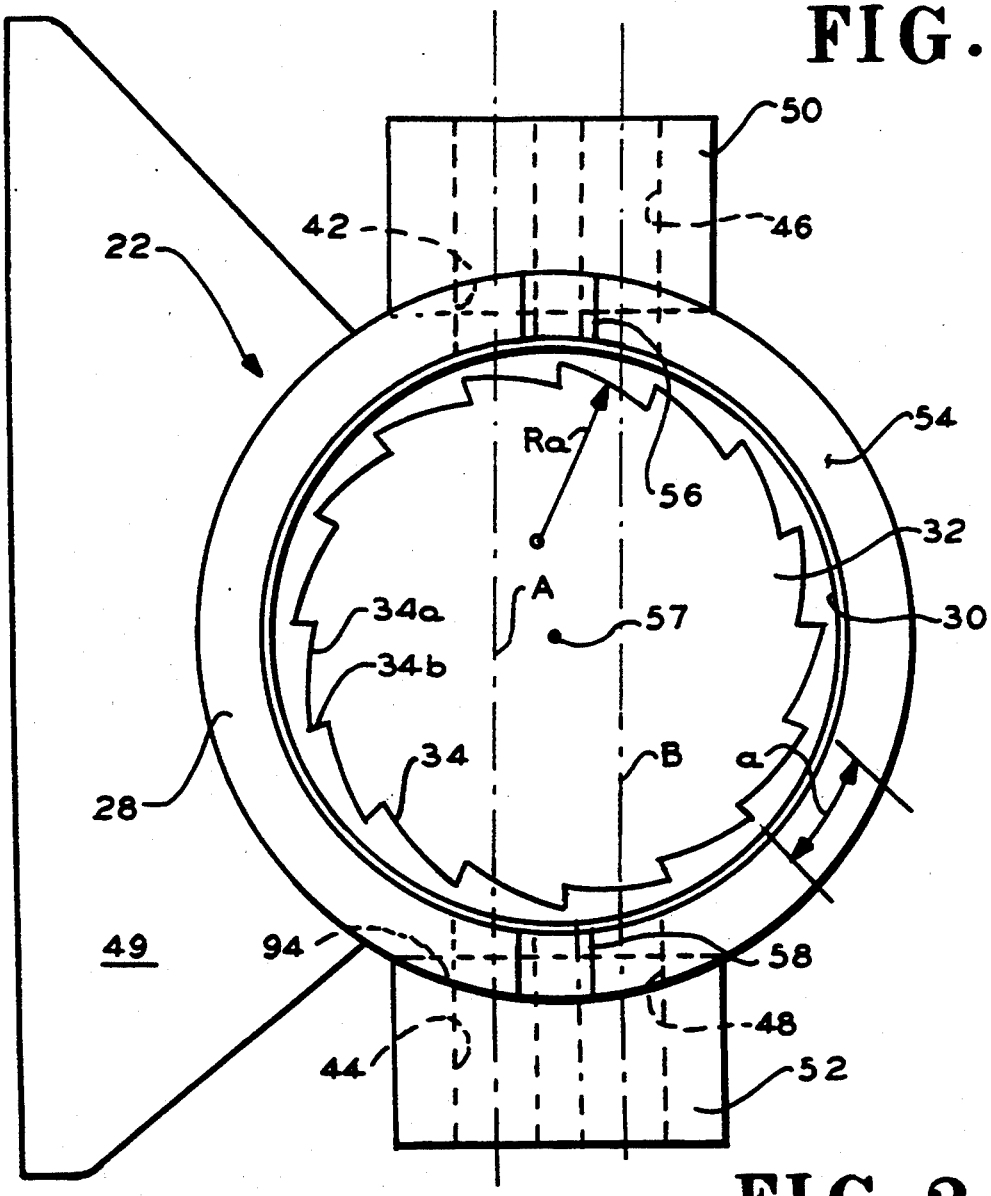
FIG. 1 is a plan view of a female housing of the rotatable seal according to one embodiment of the present invention.
Figure 2:
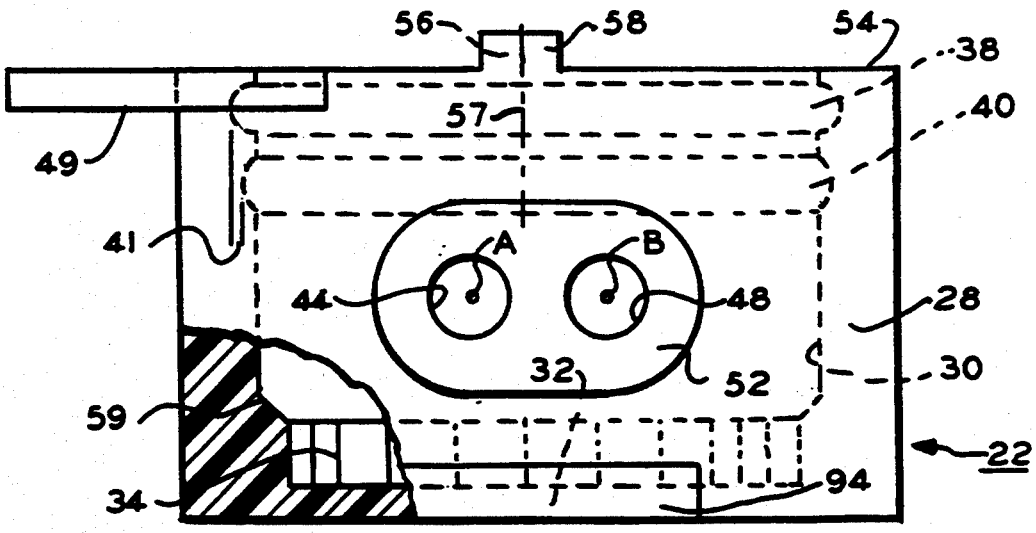
FIG. 2 is a side elevation view of the housing of FIG. 1.

In FIGS. 1 and 2, the housing 22 has a generally circular cylindrical, vertical wall 28 enclosing a circular in cross-section chamber 30 which is closed at one end by a base 32. Formed at the interior juncture of the wall 28 and the base 32 projecting into chamber 30 are a plurality of circumferential surface features including spaced ratchet teeth 34. The teeth 34, FIG. 1, each have a gradual trailing rake 34*a* and a steep leading rake 34*b*. The depth of the teeth 34 (the radial depth of rake 34*b* from central axis 57) is not critical, and the function of the teeth will be described in more detail below. In this embodiment, the teeth 34 subtend an angle a of about 22.5°. The rakes 34*a* are preferably circular and in one implementation have a radius Ra of 0.171 inches. The rakes 34*b* each lie on a radius from the center of the chamber 30 in the plan view of FIG. 1.

Near the open end of the chamber 30 and formed in the interior of the wall 28 are further surface features, comprising two spaced generally mutually parallel annular grooves 38 and 40. The diameter of the upper groove 38 is preferably slightly larger than the diameter of the lower groove 40, as shown in FIG. 2 by the distance 41. Formed through the wall 28 below the grooves 38 and 40 toward base 32 and above the teeth 34 are two pairs of bores 42, 44 and 46, 48. The bores 42 and 44 are of like diameter and are axially aligned across the chamber 30. The bores 42 and 44 are aligned on axis A. The bores 46 and 48 are aligned on axis B. The respective axes A and B extend across the chamber 30. Further, the bore pairs 42, 44 and 46, 48 are preferably mutually parallel and parallel to the base 32. Those skilled in the art will appreciate that numerous other arrangements and orientations are possible.

The housing 22 includes a flange 49 on one side of wall 28 and cowls 50 and 52 integrally formed with the wall 28 on opposite sides thereof. The cowls 50 and 52 contain continuations of the bores 42, 46 and 44, 48, respectively, and serve to lengthen these bores 42–48 for a security-related purpose described below. The flange 49 and cowls 50 and 52 may be omitted.

An upper surface 54 of the wall 28 preferably includes upstanding tabs 56 and 58, the function of which will be explained below. The tabs 56, 58 preferably lie on a diameter of the chamber 30 which is parallel to the axes A and B. The tabs 56 and 58 may be omitted in accordance with a given implementation. In FIG. 2, the chamber 30 includes a circular tapered wall 59 between side wall 28 and the teeth 34.

Figure 3:
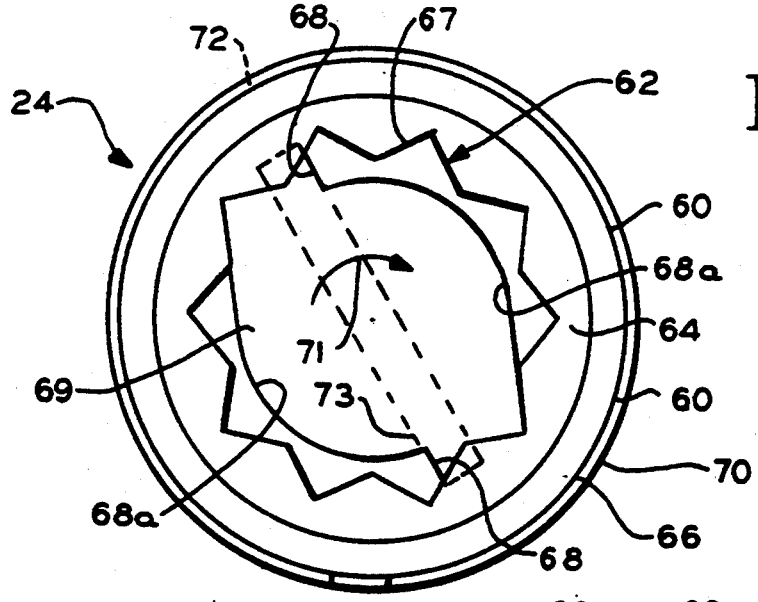
FIG. 3 is a plan view of a male member or rotor of the rotatable seal according to one embodiment of the present invention.
Figure 4:
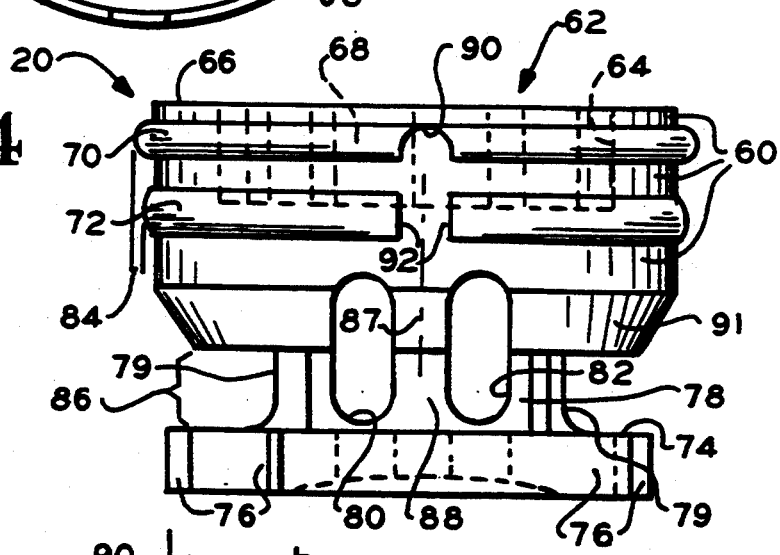
FIG. 4 is a side elevation view of the rotor of FIG. 3.
Figure 5:
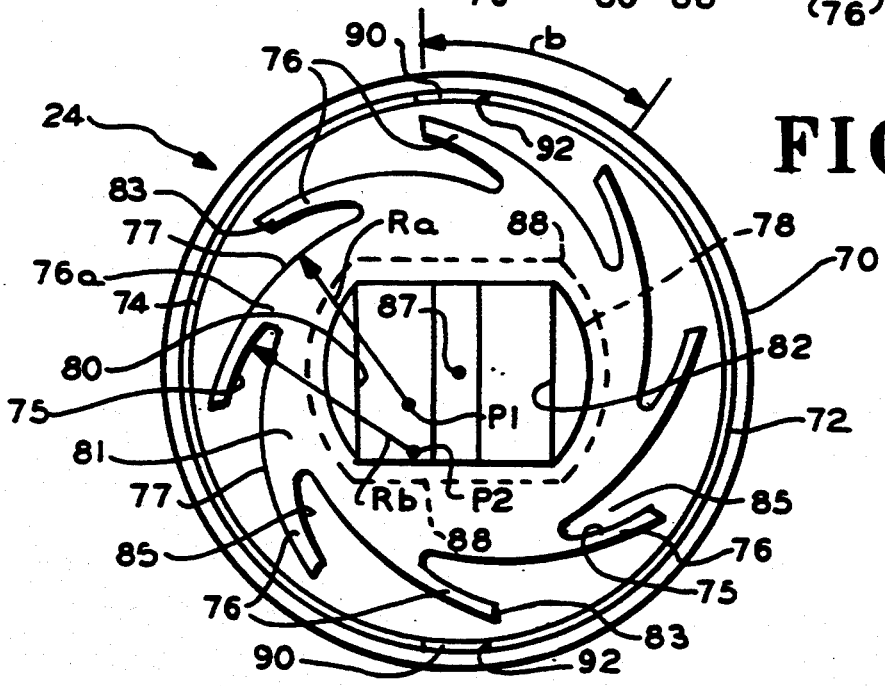
FIG. 5 is a bottom view of the rotor of FIGS. 3 and 4.

The rotor 24 is shown in detail in FIGS. 3–5. The rotor 24 is generally circular cylindrical and has various portions of varying diametrical dimensions. The rotor 24 includes a circular cylindrical head 60 with a external diameter substantially equal to that of the chamber 30 internal diameter. The head 60 has a tool-engageable member 62, which includes a depression 64 defined by a lip 66 in which is a 10 pointed external star head portion 67. A second depression 69 is formed in the top surface of member 62. Internal of star portion 67 in depression 69 are a pair of spaced parallel side walls 68 extending up from the depression 69 base wall. The portion 67, which may have a configuration other than the 10 pointed star shown, is engageable by a complimentary drive socket (not shown) the walls of which fit between the portion 67 and the lip 66 for rotation of the rotor 24 in direction 71. As will be appreciated, the head portion 67 may extend above the head 60 although coplanarity between the portion 67 and the lip 66 is preferred. The tool-engagable member 62 also has a female socket comprising depression 69 in which are side walls 68 engageable by a complementary male tool, such as the blade 73 (shown in phantom) of a screwdriver. Side walls 68 are arranged so that a screwdriver can turn head 60 only in direction 71, although this is not essential.

Formed integrally with the head 60 are vertically spaced external peripheral annular ridges 70 and 72. In certain implementations, only the lower most ridge 72 need be present and the ridge 70 may be absent.

At the bottom of the rotor 24 is a disk 74 from which are radially projecting spiral-like flexible identical teeth 76. Each tooth 76 spirals radially outwardly from the rotor 24 in a plane. The teeth 76 have a curved external surface 77, preferably a circular segment and taper cantilevered from the central portion 81 of the disk 74 to a relatively narrower tooth crest 83. Each tooth is spaced from the next adjacent tooth 76 by a spiral-like space 85. Because of the narrowing of the teeth 76 toward their crests and their cantilevered shape, the teeth 76 are radially flexible in the plane in which they lie so that they may resiliently flex when rotated in engagement with teeth 34 of the housing. The teeth 76 mate with the ratchet teeth 34 of the housing 22 and serve as a pawl mechanism relative to the ratchet teeth 34. Preferably the external surface 77 of the teeth 34 are segments of a circle as is the internal surface 75. The crests 83 each lie on a radius emanating from the rotor axis of rotation 87, FIG. 5. The teeth 76 surfaces 75 and 77 are defined by identical length radii Ra and Rb emanating from points P1 and P2 that are spaced two different radial distances from the rotor axis 87. All of the teeth 76 are generated by the same two radial distances rotated equally about the rotor axis 87. For example, in FIG. 5, tooth 76a external surface 77 is generated by radius Ra and internal sruface 75 is generated by radius Rb. All of the teeth 76 are generated by radii identical to radii Ra and Rb whose centers P1 and P2 are spaced from axis 87 in the same relationship as for radii Ra and Rb, but at different equal angular locations about axis 87. The relative angular spacing about axis 87 for each of the radii Ra and Rb is the same for each tooth 76. Thus for eight teeth 76, the raddi Ra and Rb and corresponding centers P1 and P2 are rotated eight equal distances about axis 87. Radii Ra and Rb in this implementation may be 0.171 inches. The surface 77 may subtend an angle of about 45° and the surface 75 may subtend an angle of about 22.5°.

When the spiral-like teeth 76 are aligned coplanar with ratchet teeth 34, FIG. 6a, the rotor 24 can only rotate in direction 71 due to the engagement of the pawl teeth 76 with the ratchet teeth 34. As the rotor 24 rotates in direction 71, the teeth 76 flex radially inwardly in a plane permitting relative rotation of the rotor. Normally, the quiescent state of teeth 76 is such that teeth 76 lock in engagement with teeth 34, as shown in FIG. 6a, preventing reverse rotation as occurs in a typical ratchet and pawl action. As the rotor 24 rotates, the pawl teeth 76 ride up the ramp formed by teeth 34 rake 34a and flex radially inwardly. The teeth 76 then snap return to the state shown when in this relative position.

Intermediate the head 60 and disk 74, FIG. 4, is a reduced diameter portion 78 having an axial extent 86 and two parallel elongated in transverse section bores formed as slots 80 and 82 extending through head 60. The slots 80 and 82 have an elongated axis in the vertical direction parallel to axis 87 and parallel to the side wall 28 of the chamber 30. The rotor 24 includes a chamfered shoulder 91, FIG. 4. The chamfer of shoulder 91 extends radially inwardly and downwardly in a direction toward disk 74. The purpose of the chamfered shoulder 91 will be explained more fully below. Between the chamfer shoulder 91 and disk 74 is the reduced diameter portion 78. The portion 78 has two opposite disposed curved external peripheral surfaces 79 and two opposed flat surfaces 88. The bores 80 and 82 are in communication with the surfaces 88. The flat surfaces 88 may serve as an alignment guide for automatically assembling and aligning the rotor 24 relative to the housing 22 using vibratory feed mechanisms. The reduced diameter portion 78, shoulder 91 and disk 74 define a wire-receiving channel of axial extent 86, which functions in a manner to be described below.

Figure 9:
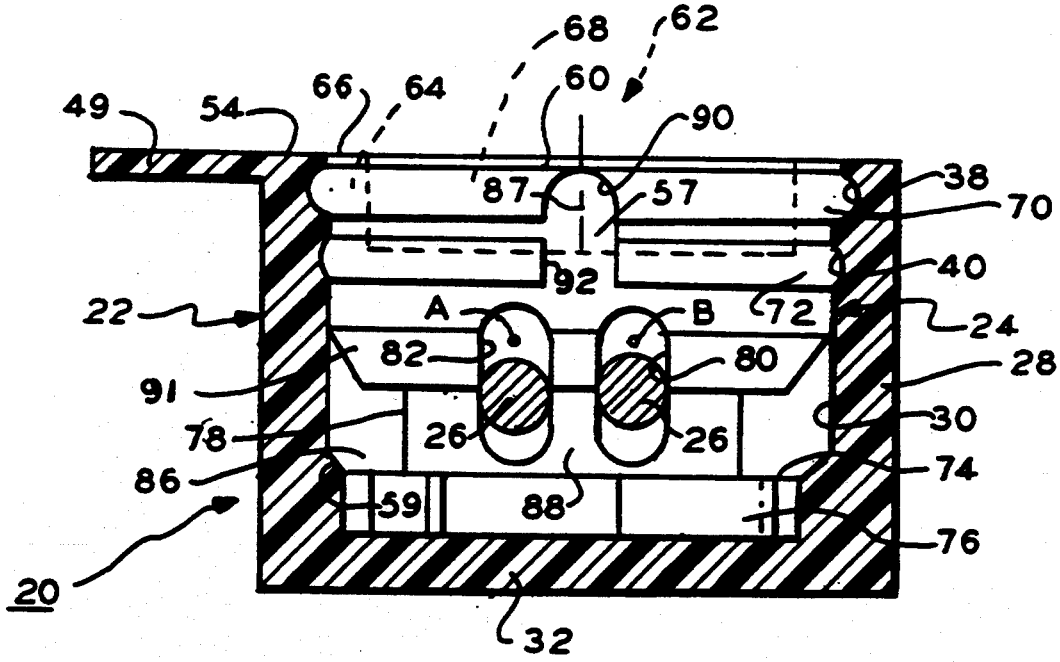
FIG. 9 is a front elevation view, partly in section, of the rotatable seal of FIG. 8.

The ridges 70 and 72 are complementary with the respective grooves 38 and 40, FIG. 9. Of course, the placement of the ridges 70, 72 and grooves 38, 40 can be reversed, with the former in the groove 40 and the latter on the rotor 24. Moreover, other complementary surface features may be used.

The rotor 24 is fully inserted axially into the chamber 30 to the axial position shown in FIG. 9. The ridge 70 is snapped into the groove 38 simultaneously with the ridge 72 being snapped into the groove 40. The diametric differences between the ridges 72 and the mating respective grooves 38 and 40 is such so that the rotor 24 is easily rotated within the chamber 30 relative to the housing 22, but is also locked axially in chamber 30 along axis 87.

The disk 74 teeth 76 are complementary to the teeth 34 in the chamber 30, as discussed above, the teeth having sufficient clearance so that upon insertion they are aligned coplanar and engaged. This engagement may be provided by simultaneous rotation of the rotor 24 relative to the housing 22 during axial insertion of the rotor into chamber 30. A relatively small circumferential clearance e.g., 0.010 (not shown) between the respective rotor and housing teeth 76 crest 83 and rotor teeth rake 34b may also be provided to assist insertion and engagement. Also tapered wall 59 is provided in channel 86 to assist in this insertion by guiding rotor teeth 76 into engagement with teeth 34. When the rotor 24 is fully inserted into the housing 22 and the ridge 72 is seated in the groove 40 (with the ridge 70 seated in the groove 38), the teeth 34 and 76 mesh and prevent relative rotation of the housing 22 and the rotor 24 in a direction opposite direction 71.

The slots 80 and 82 are spaced apart by the distance between the bore pairs 42, 44 and 46, 48 in the housing 22. When the ridges 70 and 72 are in the respective grooves 38 and 40, the rotor 24 is rotatable in the chamber 30 relative to the housing 22 and the axes of the slots 80, 82 are aligned with the axes A and B of the corresponding bores 42–48. This is shown in FIGS. 6 and 7. The rotor 24 may be rotated to align the slot 80 with one bore pair 42, 44 (or 46, 48) and to align the slot 82 with the other bore pair 46, 48 (or 42, 44). When the ridges 70 and 72 are retained in their respective grooves 38 and 40 upon full insertion of the rotor 24 into the housing 22, the slots 80, 82 are aligned with the bores 42–48 and the lower portion of the slots and the channel 86 are below (along axis 87) the axes A and B of the bores 42, 44, 46 and 48 (FIG. 9). The effective size of the channel 86 is increased by the flattened surfaces 88 of the ends of the slots 80 and 82.

The ridges 70 and 72 are preferably relieved at respective areas 90 and 92, respectively. The relieved areas 90, 92 permit conformal receipt therein of the inwardly facing portions of the housing 22, tabs 56, 58. The tabs 56, 58 may be received in the relieved areas 90 92 in one of two ways.

First, the rotor 24 may be oriented so that the bottom of the relieved areas 92, overlie the tops of the tabs 56, 58, following which the rotor 24 and the housing 22 are relatively moved axially along and in the chamber 30 until the bottom of the lower ridge 72 rests on the upper surface 54 of the wall 28 with tabs 56, 58 residing in the relieved areas 92. Subsequent insertion of the rotor 24 into the chamber 30 causes the tabs 56, 58 to first move through the relieved areas 92 and into the relieved areas 90, with the tabs 56, 58 now residing in both relieved areas 90, 92. As the tops of the tabs 56, 58 move into the relieved areas 90, the lower ridge 72 enters the upper groove 38. The rotor is then fully inserted in this aligned state engaging teeth 76 with teeth 34 axially locking the rotor in this position via the annualar ridges 70 and 72 and grooves 38 and 40.

With the tabs 56, 58 residing in the relieved areas 90, 92 and the lower ridge 72 in the upper groove 38—however this condition is achieved—inadvertent relative rotation of the housing and rotor 22 and 24 is prevented, as are inadvertent disassociation of the rotor 24 from the housing 22. The relieved areas 90, 92, the tabs 56, 58 and the bores 42–48 and slots 80, 82 are angularly and positionally located so that each slot 80 and 82 is aligned with one bore pair 42, 44 or 46, 48 when the foregoing condition is achieved. Where the tabs 56, 58 and relieved areas 90, 92 are absent, alignment of the coplanar bores 42–48 and slots 80, 82 is achieved by visual observation, rather than "automatically."

FIGS. 6–7 show specific embodiments of the rotatable seal 20 of the present invention in an opened or unsealed condition, i.e., with the rotor 24 fully inserted and axially but not rotatably locked by the ridges and grooves into the housing 22 and an undeformed seal wire 26 extending through the slots 80, 82 and bores 42, 44, 46 and 48. It should be understood that the upper ridge 70, the tabs 56, 58 and the relieved areas 90, 92 may be omitted. In U.S. Pat. No. 5,180,200, mentioned in the introductory portion, the rotor is partially inserted in the housing, the wire 26 inserted and the rotor then rotated. In contrast, in the present invention, the rotor is fully seated in the housing 22 chamber 30 and locked in place in this axial position. The seal wire 26 is then inserted into the device.

In the opened or unsealed condition of the rotatable seal 20, there are thus formed two parallel passageways 42-80-44 and 46-82-48 through the rotatable seal 20 for the seal wire 26.

Figure 8:
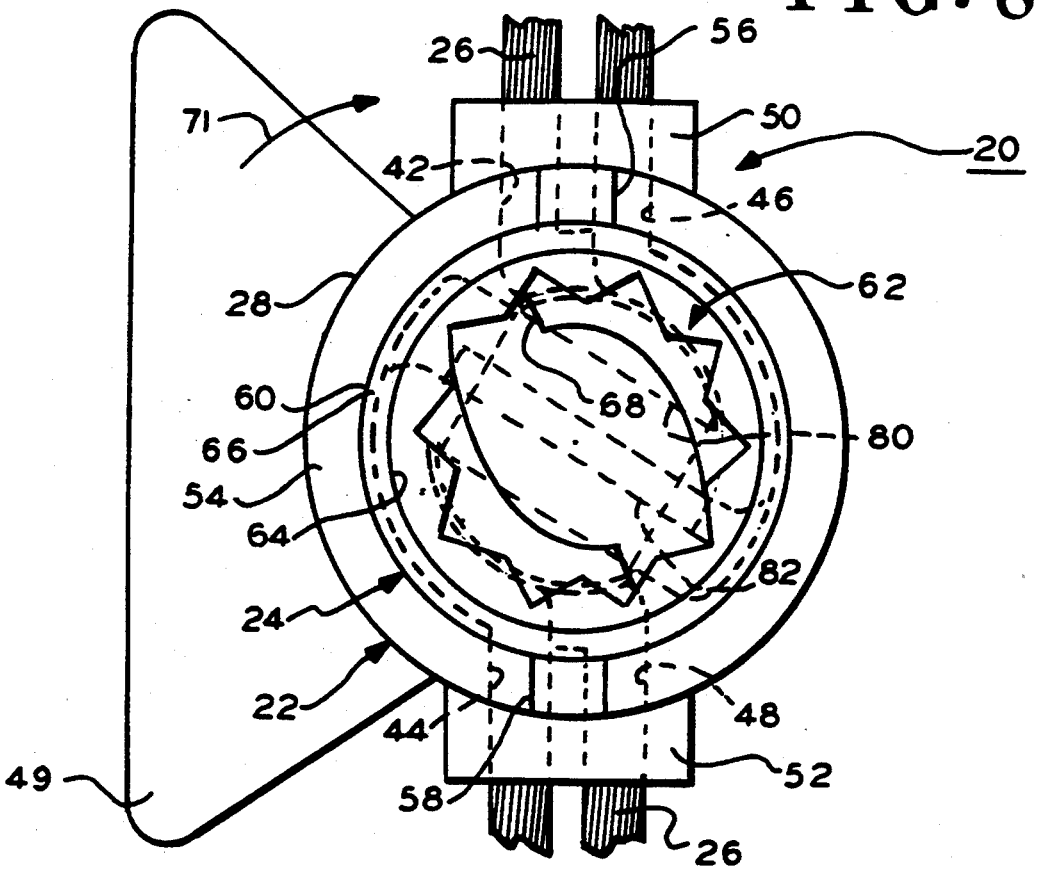
FIG. 8 is a plan view of the rotatable seal of the present invention similar to FIG. 7 but showing the rotor rotated and the deformed seal wire therein in phantom.

FIGS. 8, 9 and 10 show the rotor 24 fully inserted into the housing 22 and the rotatable seal 20 in various stages of a closed sealed condition. As best may be seen by viewing, in order, FIGS. 7–10, the seal wire 26 is first passed through the passageways 42-80-44 and 46-82-48 (FIG. 7), following which the seal wire 26 is deformed by rotating the rotor 20 relative to the housing 22 (FIG. 10) in direction 71, the rotor being axially locked in the chamber 30, but rotatable therein with the ratchet teeth 34 and pawl teeth 76 engaged. This relative rotation causes the slots 80 and 82 to be rotated out of alignment with the bore pairs 42, 44 and 46, 48 of the housing 22. The rotor 24 is rotated by the engagement and rotation of the head 60 by a tool (not shown) engaged with member 67 or walls 68. The bottom of the housing 22 may contain indentations 94, FIG. 2, and the top may include a flange 49 to assist in holding the housing 22 against rotation if deformation of the wire 26 requires high torque. The ratchet mechanism of teeth 34 and 76 prevents reverse rotation of the rotor 24 relative to the housing 22 (FIG. 6*a*).

The rotatable seal 20 is in the closed or sealed condition as shown in FIGS. 8 and 10, and the deformed seal wire 26 is displaced partially into channel 86 by the chamfer of shoulder 91 during rotation of the rotor 20. The wire 26 is also in the clearance provided by shoulder 91 and wall 28. The wire 26 slides axially downward in slots 80 and 82 during this rotation so that wire is at least partially located in the channel 86. The wire 26 is firmly locked by bending within the rotatable seal 20. The wire, being stranded, may be crushed against shoulder 91 or deformed partially in channel 86. The locking is accomplished by the rotational and axial insertional deformation of the seal wire 26 together with the concurrent locking engagement of the teeth 34 and 76 and the frictional engagement of the ridges 70 and 72 with the respective grooves 38 and 40. When the seal wire 26 has been deformed, there is a high resistance to any further relative rotation of the housing 22 in direction 71, FIG. 3. The engagement of the teeth 34 and 76 prevent the relative reverse rotation of the housing 22 and rotor 24 in a direction opposite direction 71. The seal wire may be wrapped fully around the rotor 24.

As seen in FIGS. 8 and 10, deformation of the seal wire 26 includes the wire 26 first being wrapped around the portion 78 of the rotor 24, with the wrapped wire 26 occupying and filling at least a portion of the channel 86 within the chamber 30. The flattened areas 88 on the portion 78 create additional volume for the wire 26 to prevent jamming as the rotor 24 is rotated. The amount of rotation of the rotor 24 (that shown in FIG. 8 being typical but not mandatory) occurs with inserted rotor 24 fully axially inserted (the ridge 72 is in the groove 40, and the ridge 70 is in the groove 38). Rotation of the rotor 24 further deforms the wire 26 in a direction normal to the axis of rotation of the rotor 24 by shifting the wire 26 downward toward channel 86 from the level of axes A and B, FIG. 9, at which the wire 26 enters and exits the housing 22. Both types of deformation of the wire 26—wrapping and axial—prevent both removal of the wire 26 from the seal 20 and opening of the seal 20. When the rotor is fully inserted in the housing, the upper surface of head 60 of the rotor 24 is preferably coplanar with the housing 82 upper surface 54 and forms a smooth surface with the upper surface 54 of the wall 28 of the housing 22. Such smooth surface makes it difficult for tampering action to separate the rotor 24 from the housing 22 after axially locking the rotor in the housing 22. The tool used to rotate the rotor provides sufficient torque force to overcome the temporary alignment provided by tabs 56 and 58 and the relieved areas 90 and 92.

Other features of the seal 20 may also contribute to obviating disassembly of the seal 20. First, as noted, the two modes of deforming the wire tend to resist removal of the rotor 24 from the housing 22. Second, the presence of one or both interlocked ridge-groove pairs 38–70 and 40–72 resists axial opening of the seal 20. Third, the teeth 34, 76 also help to defeat opening of the seal 20. Fourth, the cowls 50 and 52, if present, inhibit the insertion of a slender elongated object into one of the bores 42–48 and the levering of the rotor 24 by an engaging end of the object out of the chamber 30. The effective lengthening of the bores 42–48 by the cowls 50 and 52 prevents the object from being able to engage the rotor 24 in a position where levering forces can be applied.

If the rotor 24 and housing 22 are, as preferred, molded from frangible thermoplastic, attempts to tamper with the seal 20 will be evident by the chipping, cracking or crazing thereof following the application of tampering forces.

FIGS. 11–14 diagrammatically show the operation of the rotatable seal 20 of the present invention. FIG. 11 shows one end of the flexible seal wire 26 passing through the rotatable seal 20 with the rotor 24 fully inserted. FIG. 12 shows the other end of the wire 26 inserted through openings in relatively movable members 96 and 98 (hasps, staples, latches, etc.) of a latch, lock or the like. FIG. 13 shows the other end of the wire 26 passing back through the open rotatable seal 20. FIG. 14 shows the rotatable seal 20 after it has been locked in the sealing position by rotating the rotor 24 relative to the housing 22 in direction 71.

The housing 22 and rotor 24 of the rotatable seal 20 may be made from strong and essentially semi-rigid materials such as metal, rubber, plastics, etc. A preferred material is acrylic plastic. The housing 22 and rotor 24 of the rotatable seal 20 may also be made from clear materials so that alignment of the bores 42–48 and slots 80, 82 and the positive locking of the seal wire 26 can be inspected and can also provide a visual indication of tampering.

The flexible seal wire 26 used with the rotatable seal 20 of the present invention may be in the form of stranded or solid wire, rope or cable, and may be made of metal, plastic or other suitable materials.

When the seal 20 is in the locked condition, the interfitting members 22 and 24 must be destroyed, or the seal wire 26 must be cut, in order to remove the seal 20 from the members 96 and 98 so that these members can be moved or operated. Due to the strong materials of construction, substantial effort is required either to destroy the members 22 or 24 or to cut the wire 26. However, if such destruction or cutting is effected, there is provided an easily detectable indication of tampering.

The conjoint action of the tabs 56, 58 and the relieved areas 90, 92 where present, and of the lower ridge 72 and the upper groove 38, permits the manufacturer of housings 22 and rotors 24 to easily preassemble them with the rotor 24 fully inserted and with the passageways 42-80-44 and 46-82-48 ready to receive the ends of the wire 26. This bore alignment is automatically achievable by the action of the tabs 56, 58 and the relieved areas 90, 92 via relative rotor-housing 24-22 rotation—either before or after ridge-groove 72-38 engagement—unskilled, low cost labor or automatic machinery can readily and quickly preassemble the seal 20 into a ready-to-use, assembled condition. It should be understood, that while tabs 56 and 58 and relieved areas 90 and 92 engage for alignment purposes, the material is sufficiently flexible so that they disengage upon forced relative rotation.

While the present invention has been described with regard to certain embodiments, it should be understood that variations and modifications will be obvious to those skilled in the art without departing from the scope of the present invention as defined in the appended claims.

What is claimed is:

1. A seal of the type which includes a flexible wire insertable through an item to be secured, the seal being non-removably affixable to the wire to prevent opening operation of the item absent destruction of the wire or the seal, such destruction providing a visual indication that such operation has been attempted or has occurred, the seal comprising:

a housing defining a chamber and having first and second aligned bores formed through opposite sides of the chamber;

a rotor received in the chamber in a first axial direction and having a third bore therethrough;

first means for axially locking the rotor fully inserted in the chamber with the third bore aligned with the first and second bores, all said bores for receiving said wire therethrough; and second means for permitting the fully inserted and axially locked rotor and the housing to be relatively rotated to a first position in only one direction after insertion of the wire through the bores so as to at least partially wrap and deform the received wire about the rotor, said second means and deformed wire rotatably locking the rotor relative to the housing in said first position.

2. The seal of claim 1, wherein the first and second means comprise complementary surface features on the rotor and on the chamber sides.

3. The seal of claim 1, wherein the first means comprises a first annular ridge on one of said rotor and side walls, and a first annular groove complementary with the ridge and formed in the other of said rotor and housing side within the chamber, the first ridge engaging the first groove when the rotor is inserted into the chamber.

4. The seal of claim 3, wherein the second means comprises complimentary ratchet and pawl means including ratchet teeth on said chamber side and at least one radially extending pawl tooth on said rotor engaged with said ratchet teeth.

5. The seal of claim 4, which further comprises third means for maintaining the alignment of the bores until the inserted rotor and the housing are relatively rotated to wrap and deform the wire.

6. The seal of claim 4 wherein the third means comprises a tab formed on the housing wall at the point of insertion of the rotor into the chamber, and a relieved area complementary with the tab and formed in the annular ridge.

7. The seal of claim 4, wherein the ratchet teeth each have leading and trailing edges and are in an annular array in the chamber extending radially inwardly from the chamber side and having a first relatively steep leading edge rake with respect to the trailing edge and a second trailing edge relatively gradual rake with respect to the leading edge, said at least one pawl tooth comprising an annular array of like flexible, radially outwardly extending cantilevered teeth which selectively engage with said ratchet teeth.

8. The seal of claim 7, which further comprises third means for maintaining the alignment of the bores until the inserted rotor and the housing are relatively rotated to wrap and deform the wire.

9. The seal of claim 1 wherein the third bore comprises a slot extending in said first direction.

10. The seal of claim 1, wherein:

the second means comprises a plurality of first teeth formed on the rotor, and a plurality of second teeth formed on the housing within the chamber, the teeth on the rotor engaging the teeth in the chamber to prevent relative rotation of the rotor and the housing in a second direction while permitting incremental relative rotation only in a third direction opposite the second direction when the rotor is fully inserted.

11. The seal of claim 1 which further comprises:

first and second cowls integral with the exterior of the housing, the cowls surrounding and providing external extensions for the first and second bores, the extension of the bores preventing an object inserted thereinto from being used as a lever against the rotor to remove the fully inserted rotor from the chamber.

12. The seal of claim 1 wherein with the rotor fully inserted and followed by relative rotation of the rotor and the housing to wrap the inserted wire, the bores being rotationally misaligned, the first, second and third bores are arranged so that the deformed wire follows a tortuous non-planar path.

13. The seal of claim 1 further including means for maintaining the alignment of the bores until the inserted rotor and the housing are relatively rotated to wrap and deform the wire.

14. The seal of claim 13 further including means for preventing the removal of the fully inserted rotor by an object inserted into the first or second bore.

15. The seal of claim 1 wherein the housing has a first pair of bores on one side of the chamber and a second pair of bores on the opposite side of the chamber, each bore of the first pair being aligned with a different bore of the second pair to form aligned first and second sets of bores, the rotor including a third pair of bores, each bore of the third pair being aligned with a different one of said sets of bores when the rotor is axially locked.

16. The seal of claim 1 wherein the second means comprises complementary ratchet and pawl means, one of the ratchet means and pawl means being secured to the housing in the chamber and the other of said ratchet means and pawl means being secured to the rotor.

17. The seal of claim 15 wherein the bores of the third pair are each a slot having an extent in the axial direction greater than that of the bores of the first and second pair.

* * * * *